US008453408B2

(12) United States Patent
Kalkanoglu et al.

(10) Patent No.: US 8,453,408 B2
(45) Date of Patent: Jun. 4, 2013

(54) PRE-ASSEMBLED HIP, RIDGE OR RAKE SHINGLE

(75) Inventors: Husnu M. Kalkanoglu, Swarthmore, PA (US); Gregory F. Jacobs, Oreland, PA (US)

(73) Assignee: CertainTeed Corporation, Valley Forge, PA (US)

( * ) Notice: Subject to any disclaimer, the term of this patent is extended or adjusted under 35 U.S.C. 154(b) by 1272 days.

(21) Appl. No.: 11/689,574

(22) Filed: Mar. 22, 2007

(65) Prior Publication Data

US 2008/0229695 A1 Sep. 25, 2008

(51) Int. Cl.
*E04D 1/00* (2006.01)

(52) U.S. Cl.
USPC ..... 52/520; 52/43; 52/748.1

(58) Field of Classification Search
USPC ..... 52/43, 518, 520, 555, 105; 428/515
See application file for complete search history.

(56) References Cited

U.S. PATENT DOCUMENTS

| | | | | | |
|---|---|---|---|---|---|
| 4,907,499 | A | * | 3/1990 | James | 454/365 |
| 5,095,810 | A | * | 3/1992 | Robinson | 454/365 |
| 5,109,149 | A | | 4/1992 | Leung | |
| 5,122,095 | A | | 6/1992 | Wolfert | |
| 5,271,201 | A | * | 12/1993 | Noone et al. | 52/518 |
| 5,295,340 | A | * | 3/1994 | Collins | 52/518 |
| 5,419,941 | A | | 5/1995 | Noone et al. | |
| 5,458,538 | A | | 10/1995 | MacLeod et al. | |
| D366,335 | S | | 1/1996 | Noone et al. | |
| D366,336 | S | | 1/1996 | Noone et al. | |
| 5,570,556 | A | * | 11/1996 | Wagner | 52/552 |
| 5,711,126 | A | * | 1/1998 | Wells | 52/519 |
| 5,772,502 | A | | 6/1998 | Smith | |
| 5,916,103 | A | * | 6/1999 | Roberts | 52/552 |
| 5,956,913 | A | * | 9/1999 | Nicholson | 52/520 |
| 6,418,692 | B1 | | 7/2002 | Freshwater et al. | |
| 6,470,642 | B1 | * | 10/2002 | Eads | 52/518 |
| 6,482,084 | B2 | | 11/2002 | Hansen | |
| 6,725,609 | B2 | * | 4/2004 | Freiborg et al. | 52/57 |
| 7,178,294 | B2 | | 2/2007 | Jolitz | |
| 2003/0077999 | A1 | * | 4/2003 | Mankowski | 454/365 |
| 2004/0221536 | A1 | * | 11/2004 | Kalkanoglu et al. | 52/518 |
| 2004/0237428 | A1 | * | 12/2004 | Headrick et al. | 52/198 |
| 2006/0292979 | A1 | * | 12/2006 | Stearns | 454/365 |

* cited by examiner

*Primary Examiner* — William Gilbert
(74) *Attorney, Agent, or Firm* — Paul & Paul

(57) ABSTRACT

A hip, ridge or rake shingle is provided, in which a pair of substantially rigid panel portions are connected by a hinge portion, and wherein the shingle is pre-assembled, but can conform to a variety of different angles to accommodate different angular relationships between surfaces of a hip, ridge or rake of a roof.

20 Claims, 8 Drawing Sheets

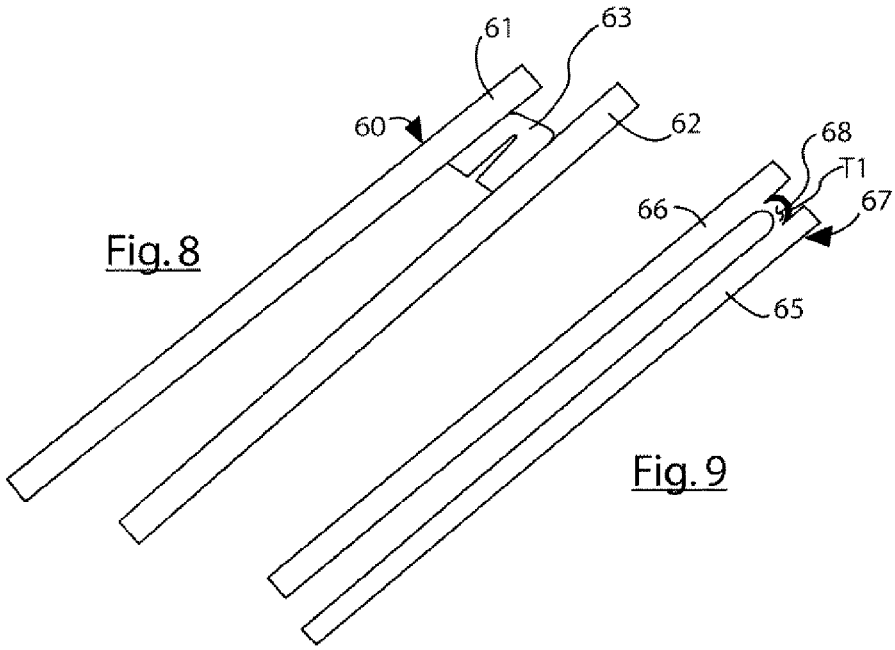
Fig. 8
Fig. 9
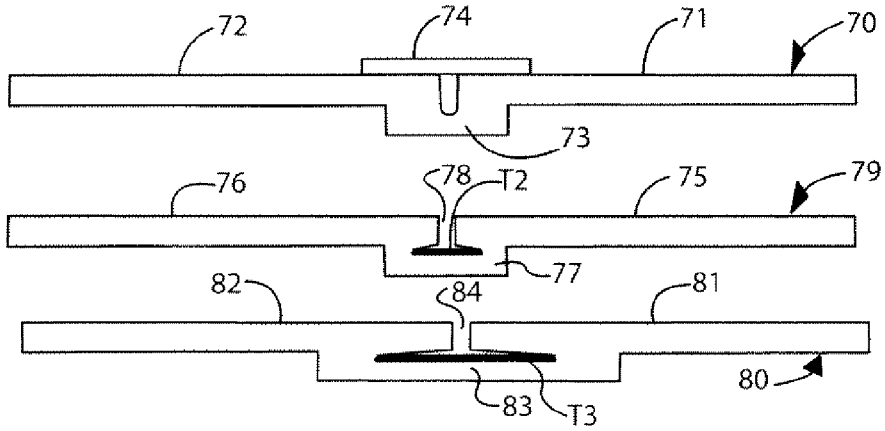
Fig. 10
Fig. 11
Fig. 12

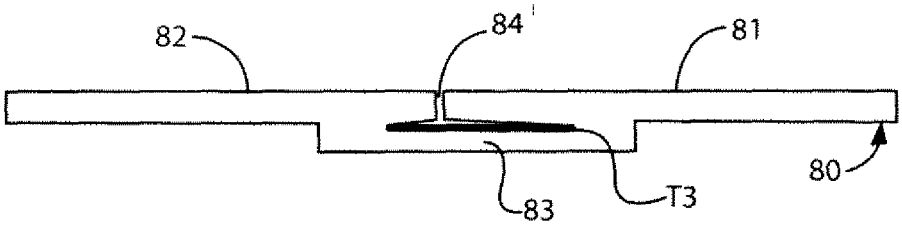
Fig. 12A
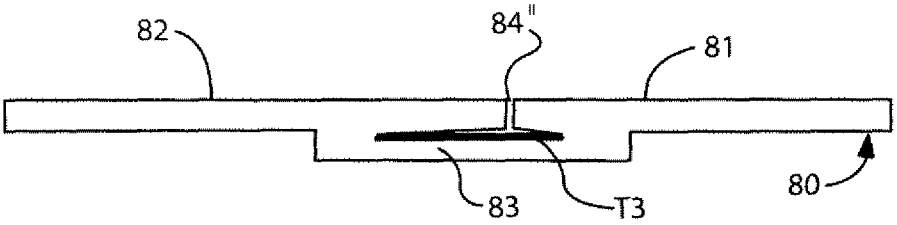
Fig. 12B
Fig. 13
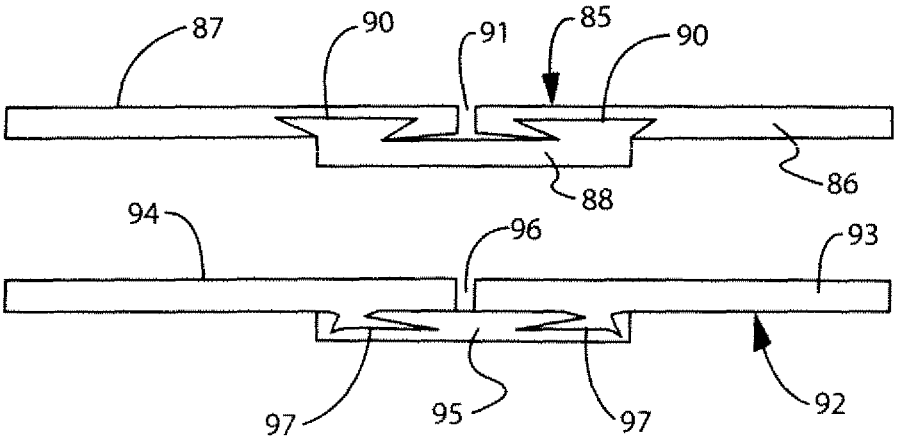
Fig. 14

PRE-ASSEMBLED HIP, RIDGE OR RAKE SHINGLE

BACKGROUND OF THE INVENTION

It is known in the shingle art that shingles that are applied to a roof are generally applied in courses, running up the slope of a roof, toward the apex or ridge of the roof For example, in applying shingles to different sloped surfaces of a roof, wherein those sloped surfaces meet at an apex, the various courses of shingles on each side of the apex are increasingly disposed up each slope, until the apex or ridge of the roof is reached. At that point, it is desirable to provide a shingle that is a unitary structure that overlies a portion of each sloped surface of the roof, including the apex of the roof Sometimes, a piece of shingle is cut to be applied over the shingles on each sloped surface, and over the apex in an inverted "V" manner. In bending such shingle, generally when it is of the manufactured asphalt shingle type, it is possible that, as the shingle is bent to have an included angle between surfaces thereof to partially cover each surface of the roof as well as the apex of the roof cracks can form.

In instances where the shingles are substantially rigid, such as resembling slate, tile, shakes or the like it is often not practical to bend a shingle to cover the surfaces on each side of the apex of a roof. In some such cases molded plastic ridge cap pieces are applied to cover the gap at the roof edge. In other instances, a row of barrel-like tiles are applied over the apex of a roof. In still other instances, molded bent synthetic slate shingles are pre-shaped to a specific angle, to be applied over the ridge of a roof.

Examples of prior art techniques floor covering) a hip, ridge or rake portion of a roof exist in U.S. Pat. Nos. 5,295,340, 6,418,692, and 7,178,294.

THE PRESENT INVENTION

The present invention is directed to closing the ridge or hip of a roof that is made up of slates, tiles or shakes without requiring special flashing or a tile arrangement along the top edge of the roof in order to close the roof and prevent water from entering the structure being roofed at the joint between the two slopes of the roof.

SUMMARY OF THE INVENTION

The present invention provides a hinged, pre-assembled hip, ridge or rake shingle that can be used for synthetic slate, tile, or shake roofing installations, wherein the hinge allows the shingle to accommodate a wide range of intersecting angles on each side of the hip, ridge or rake, at the meeting of a roof joint.

Accordingly, it is an object of this invention to provide a synthetic hip, ridge or rake roofing shingle of the simulated slate tile or shake types, wherein planar portions are connected by a hinge-like portion, in which the hinge-like portion is relatively flexible relative to the substantially, relatively rigid planar portions, whereby the hinge-like portion can conform to a variety of different angles between the substantially rigid planar portions, which angles correspond to different intersecting angles of different adjacent roof surfaces.

It is another object of this invention to accomplish the above object, wherein the hinge-like portion is either of the same material, or of a different, softer, more flexible material than the material of construction of the relatively rigid planar portions of the shingle.

It is another object of this invention to accomplish the above objects, wherein the hinge-like portion of the shingle includes a reinforcement.

Other objects of the invention include accomplishing the above objects, wherein the hinge-like portion is a separate member that is either laminated to the relatively rigid panel portions, heat sealed thereto, adhesively connected thereto, or mechanically fastened or mechanically interlocked thereto.

It is a further object of this invention to accomplish the above objects, wherein the relatively rigid panel portions are connected together by a layer of release tape across the hinge-like portion, to facilitate stacking of the shingles in substantially flattened condition, or to facilitate the operability of the hinge-like portion to accommodate various potential angles between the panel portions in the installed condition of shingles on a roof.

BRIEF DESCRIPTION ON THE DRAWINGS FIGURES

FIG. 8 is an end view of another alternative embodiment of the shingle of this invention.

FIGS. 9-20 are end views of other alternative embodiments of the shingle of this invention.

DETAILED DESCRIPTION OF THE PREFERRED EMBODIMENTS

Figure 1:
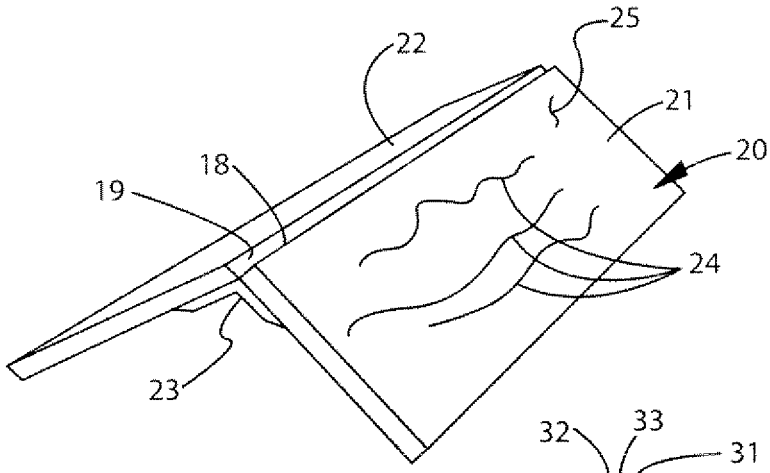
FIG. 1 is a top perspective view of a shingle in accordance with this invention.
Figure 2:
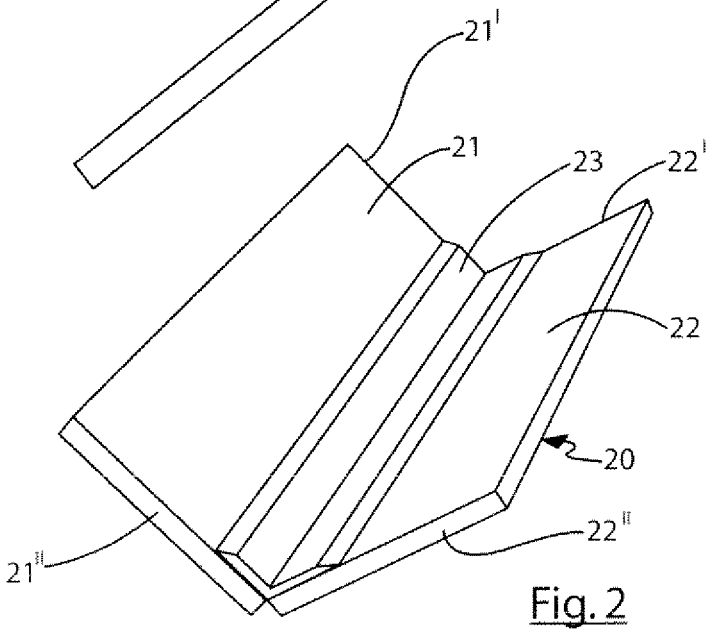
FIG. 2 is a bottom perspective view of the shingle of FIG. 1 in accordance with this invention.

Referring now to the drawings in detail, reference is first made to FIG. 1, wherein a shingle 20 in accordance with this invention is illustrated as having a pair of substantially rigid planar portions 21 and 22, having opposite ends 21', 21", 22', 22"as shown in FIGS. 1 and 2, and which are connected together by a hinge-like portion 23 that is softer, relatively more flexible than the substantially ridge-like planar portions, to facilitate bending to different angles as may be required with the hinge-like portion being co-extensive between said opposite ends 21', 21", 22', 22"of said rigid planar portions 21 and 22 as is shown in FIG. 2. The relatively flexible portion 23 in the embodiment of FIG. 1 is of a separate structure, or different material than portions 21 and 22 and can be rubber-like or elastomeric.

A plurality of relief zones or areas 24 are provided on the upper exterior surface 25 of the shingle 20, simulating natural slate, tile, or shake, such as cedar shake, shingles or the like, with the aesthetic presentation of the relief areas 24 being selected as may be desired.

Each of the substantially rigid panel portions 21, 22, may, if desired, be constructed of a single material, or, alternatively, they may be constructed of a core material having exterior surfaces that would be weather-exposed in the installed condition on a roof being a capstock material coating thereon (not shown).

Figure 3:
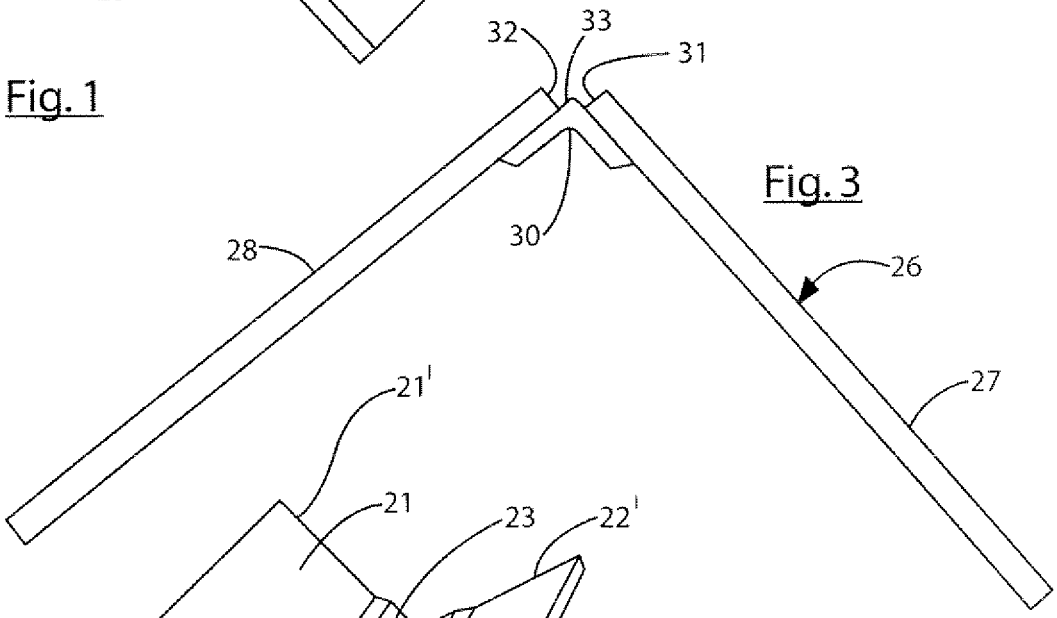
FIG. 3 is an end view of a slightly modified form of the shingle of FIG. 1 of this invention.

With reference to FIG. 3, an alternative shingle 26 is provided, comprised of panel portions 27 and 28 that are substantially rigid, connected by a substantially flexible hinge-like portion 30, as shown, wherein, upper edges 31 and 32 do not extend completely to the apex 33 of the hinge-like portion 30 shown in FIG. 3, unlike the shingle 20 of FIG. 1, in which the edges 18 and 19 meet as shown in FIG. 1.

Otherwise, the shingle of FIG. 3 is similarly constructed to the construction of the shingle 20 of FIG. 1.

Figures 4, 5, 6, 7:
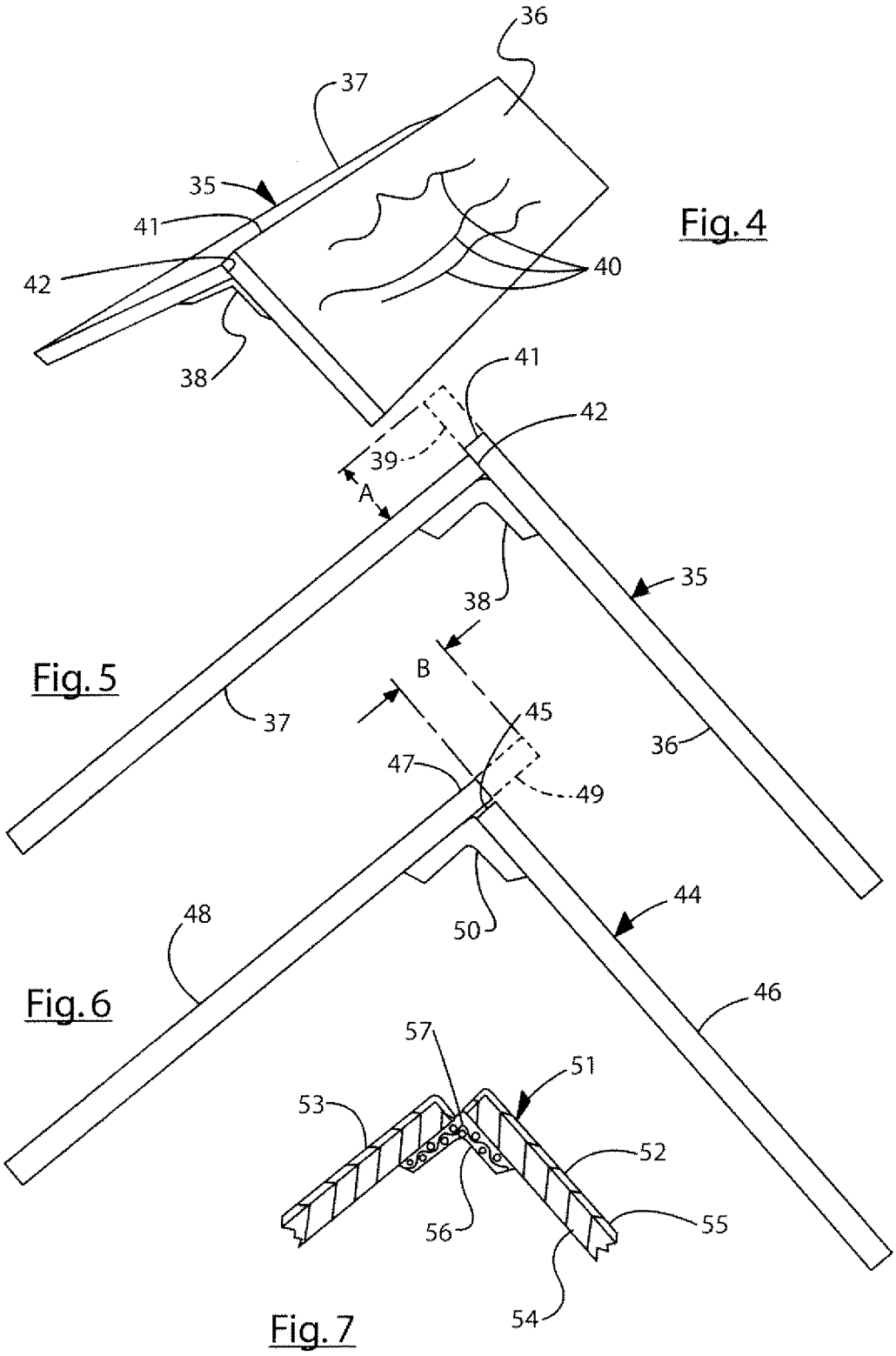
FIG. 4 is a top perspective view of another alternative embodiment of the shingle of this invention.
FIG. 5 is an end view of the shingle of the embodiment of FIG. 4 in accordance with this invention.
FIG. 6 is an end view of another alternative embodiment of the shingle of this invention.
FIG. 7 is a fragmentary transverse sectional view, taken through another alternative embodiment of the shingle, wherein the shingle of FIG. 7 embodies substantially rigid planar portions each of core and capstock material, connected together by a hinge of material having a fabric-like reinforcement embedded therein.

With reference to FIG. 4, a shingle 35 is shown, having substantially rigid panel portions 36, 37 connected by a hinge-like portion 38. The shingle of FIG. 4 is constructed to be similar to the shingle of FIG. 1, likewise having relief areas 40 thereon as maybe desired, except that the upper end 41 of the substantially rigid panel portion 36, overlies the upper end 42 of the substantially rigid panel portion 37, as shown in FIG. 4, FIG. 5 provides an end view of the shingle illustrated in FIG. 4.

FIG. 6 illustrates a shingle similar to that of FIG. 5, identified generally by the numeral 44, but wherein the upper edge 45 of the substantially rigid panel portion 46 is covered by the upper end 47 of the substantially rigid panel portion 48, in a manner opposite to the arrangement of FIG. 5, with a substantially flexible hinge-like portion 50 connecting the same.

In the embodiments illustrated in FIGS. 5 and 6, there are shown in phantom optional respective projections 39 and 49, respectively, of rigid panel portions, extending respective amounts "A" and "B", for aesthetic purposes, simulating additional height or thickness at the bend of the hip/ridge/rake shingles 35, 44, respectively, when installed, as possible other features for those shingles 35 and 44.

In all of the embodiments illustrated in FIGS. 1-6, it will be seen that the hinge-like portions 23, 30. 38 and 50 are of a separate material than the material of construction of the substantially rigid panel portions, and is more readily foldable, or rubber-like, and can be adhered to the substantially rigid panel portions by any of a variety of techniques, such as being laminated thereto, being heat sealed thereto, being adhesively secured thereto, or mechanically fastened thereto in some manner as will be described in examples later to be discussed herein.

With reference now to FIG. 7, a hip ridge or rake shingle 51 is shown, in section, in which each of the substantial rigid panel portions 52, 53 is comprised of a core material 54 having its weather-exposed portions in the installed condition, covered by a capstock material 55, as shown. A separate material is used to provide the substantially flexible hinge-like portion 56. The hinge-like portion 56 is secured to each of the substantially rigid panel portions 52 by any of the techniques described above. However, in the embodiment of FIG. 7, the hinge-like portion 56 is provided with a reinforcement member 57 that can be a woven scrim, or woven fabric, for example. The reinforcement could also be a non-woven scrim or fabric, or even a film, any of which reinforcements can be embedded into the hinge-like portion 56, such as during a molding operation or the like, or could be adhered to either an upper or lower surface of the hinge-like portion 56 (not shown).

With reference to FIG. 8, another hip, ridge or rake shingle 60 is illustrated, comprising substantially rigid panel portions 61 and 62, connected by a relatively flexible hinge-like portion 63, also comprising a different element than either of panel portions 61, 62, preferably constructed of a different softer material than the material of construction of either of the substantially rigid panel portions 61, 62.

In FIG. 9, yet another alternative embodiment is illustrated, wherein the substantially rigid panel portions 65, 66 of the hip, ridge or rake shingle 67 are connected by a hinge-like portion 68 that is constructed of the same material of construction as are the substantially rigid panel portions 65, 66, but in order to be flexible, the hinge-like portion 68 may be thinner, or may be scored (not shown), or otherwise mechanically altered to bend more easily and be more flexible for serving the function of a hinge-like member.

With reference to FIG. 10 it will be seen that a hip, ridge or rake shingle member 70 is shown, which can be of a single material of construction, having substantially rigid panel portions 71 and 72, connected by a thinner hinge-like portion 73, which enables the shingle 70 to be molded of a unitary material, or of a core material having a capstock material thereon (not shown). In the embodiment of FIG. 10, a sheet of release tape 74 is shown connecting the relatively rigid panel portions 71 and 72, across the hinge-like portion 73, to keep the shingle 70 generally flat, for purposes of stacking a plurality of shingles in a container, one atop the other, for example. The release tape 74 may be removed for purposes of bending the shingle 70 to have different angular accommodations depending upon the slopes of different surfaces of a roof to which is applied, or the tape 74 could simply be released from one side, to be free of one of the panel portions 71 or 72, for purposes of installation of the shingle 70 on a roof.

The shingle 79 of FIG. 11 illustrates another alternative embodiment, in which the hinge-like portion 77 is unitary with the substantially rigid panel portions 75 and 76, and in the flattened condition shown has a space 78 between the substantially rigid panel portions, so that in the configuration shown in FIG. 11, the shingle 79 may also be readily stacked.

In FIG. 12, there is illustrated a shingle 80, somewhat similar to the shingle 79 of FIG. 11, but wherein the substantially rigid panel portions 81 and 82 are connected by a differently configured hinge-like portion 83 than that 77 for the shingle 79 of FIG. 11, but wherein the substantially rigid panel portions likewise have a space 84 therebetween, in the flattened condition shown for the shingle 80, also for stacking purposes, but wherein the hinge-like portion is substantially wider than that shown in FIG. 11.

With reference, for example, to FIGS. 9, 11, and 12, it will be seen that those shingles 67, 79 and 80, respectively are adapted to being molded, such that their substantially rigid panel portions as well as their hinge-like portions, can be molded together as a unit. However, in order to allow separation of the substantially rigid panel portions of each shingle in the vicinity of the hinge-like portions, there can be provided strips of release tape T1, T2 and T3, respectively, to keep the substantially rigid panel portions and their connecting hinge-like portions from becoming adhered together, to allow the ready bending of the integrally molded shingles 69, 79, 80, respectively, to be bent from their originally flattened conditions, such that their opposing substantially rigid portions can be bent to have an angular relationship to each other, somewhat like the bent shingles of FIGS. 1 through 7.

Figure 20:
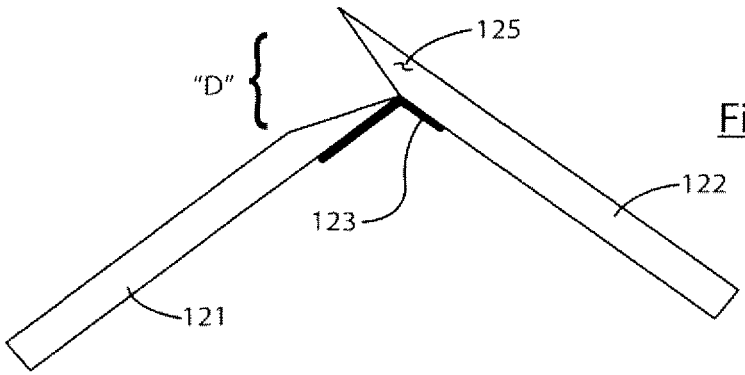

With reference to FIGS. 12A and 12B, it will be seen that the space 84 illustrated in FIG. 12 could be located either leftward of center, as shown in FIG. 12A, and which is indicated as 84', or rightward of center as shown in FIG. 12B, and which is indicated as 84", such that when the shingle of either of FIG. 12A or 12B is bent along the hinge-like portion 88 thereof, a projected height or aesthetic purposes can be provided for either of the substantially rigid panel portions 81 or 82, somewhat similar to the extension portions of FIGS. 5, 6 and 20 herein.

With reference to FIG. 13, a hip, ridge or rake shingle 85 is illustrated, in which the substantially rigid panel portions 86 and 87 are connected by substantially flexible hinge-like portion 88, which has a dovetail type mechanical interlock 90 connecting the hinge-like portion 88 to the substantially rigid panel portions 86 and 87, across the space zone 91, as shown, and wherein the substantially flexible hinge-like portion 88 is comprised of a different material element than either of the substantially rigid panel portions 86 and 87.

In FIG. 14, a hip ridge or rake shingle 92 is illustrated, comprised of substantially rigid panel portions 93 and 94, connected together by substantially flexible hinge-like portion 95, across the space 96 between the substantially rigid panel portions, and wherein a different dovetail type connection that forms a mechanical interlock 97, is shown, relative to that illustrated in FIG. 13. The hinge-like portion 95, like that 88 of FIG. 13, is shown being comprised of a different material element, selected to be sufficiently flexible to act in the manner of a hinge when the substantially rigid panel portions 93 and 94 are folded to have an included angle therebetween to accommodate a hip, ridge or rake of a roof of any desired slopes between surfaces thereof.

The embodiments of FIGS. 13 and 14, like those of FIGS. 10-12, illustrate the manner in which the shingles may be stored and shipped in relatively flattened form, to be folded to the desired angles when applied to roofs.

Figure 15:
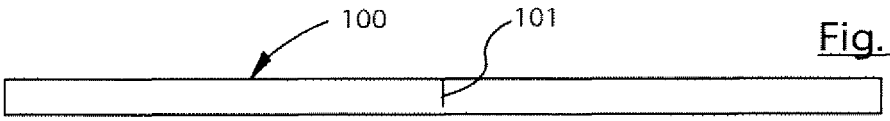
Figure 16:
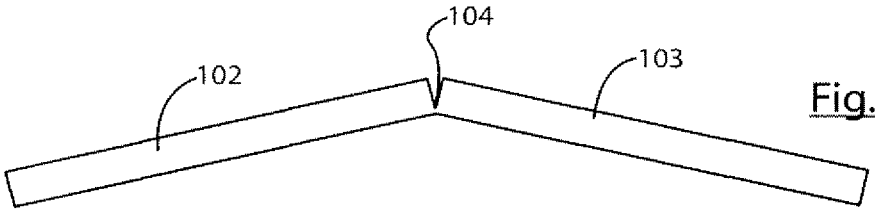

With reference now to FIG. 15, a shingle 100 is shown, which is molded into the flat form illustrated in FIG. 15, and simultaneously therewith or thereafter a cut 101 can be made after the shingle or tile is molded, which cut 101 will facilitate the bending of the shingle thereafter as shown in FIG. 16 to have two substantially rigid portions 102 and 103 foldable as shown, along a fold line 104, such that the shingle or tile can thus conform to the shape of the ridge of a roof or to other angularly related surfaces of a roof.

Figure 17:
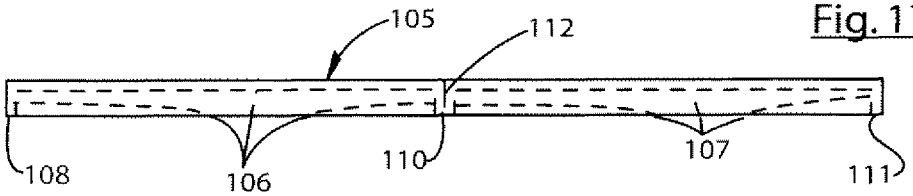
Figure 18:
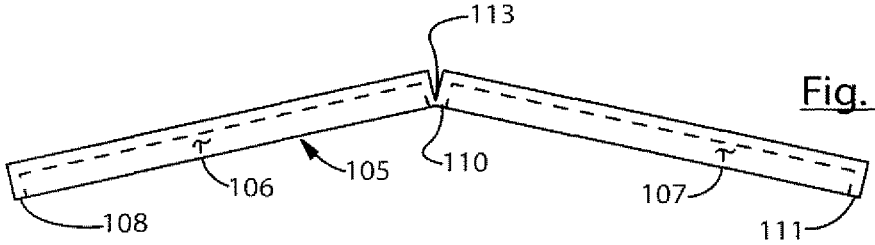

With reference to FIG. 17, a shingle 105 is shown, similar to that 100 of FIG. 15, and which is hollowed-out at 106 and 107, to reduce weight and to reduce the amount of material required, but wherein ribs 108, 110 and 111 facilitate the support of the shingle or tile on the roof, when installed. Like the illustration of FIG. 16, the shingle 105 can have a cut 112 applied with the making of the shingle, or thereafter, to yield a fold line 113 as shown in FIG. 18. Alternatively, the cut lines 101 and 112 of FIGS. 15 and 17, respectively, could be score lines, if desired, which could become open cut lines as the shingles 100, 105, respectively are bent from their flattened positions illustrated in FIGS. 15 and 17, respectively, to their bent positions illustrated in FIGS. 16 and 18, respectively.

Figure 19:
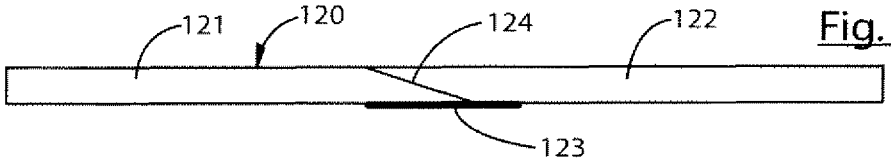

With reference to FIG. 19, another shingle or tile 120 is illustrated in flattened form, as comprising two parts 121 and 122, connected by a laminated or otherwise foldable member 123, with the two components 121 and 122 having a separation or cut line 124 therein, with the cut line 124 being of the beveled type shown, and with the laminate or other layer 123 providing a hinge-like effect, such that, when the shingle is bent from its position illustrated in FIG. 19 to the position illustrated in FIG. 20, the upwardly extending portion 125 of component 122 projects upwardly an amount "D", yielding a projected height "D" for aesthetic purposes, simulating additional height or thickness at the bend of the hip/ridge/rake shingle when installed, but with the shingle or tile also having the ability to lay flat as shown in FIG. 19, for packaging purposes, shipment, or the like.

Figure 21:
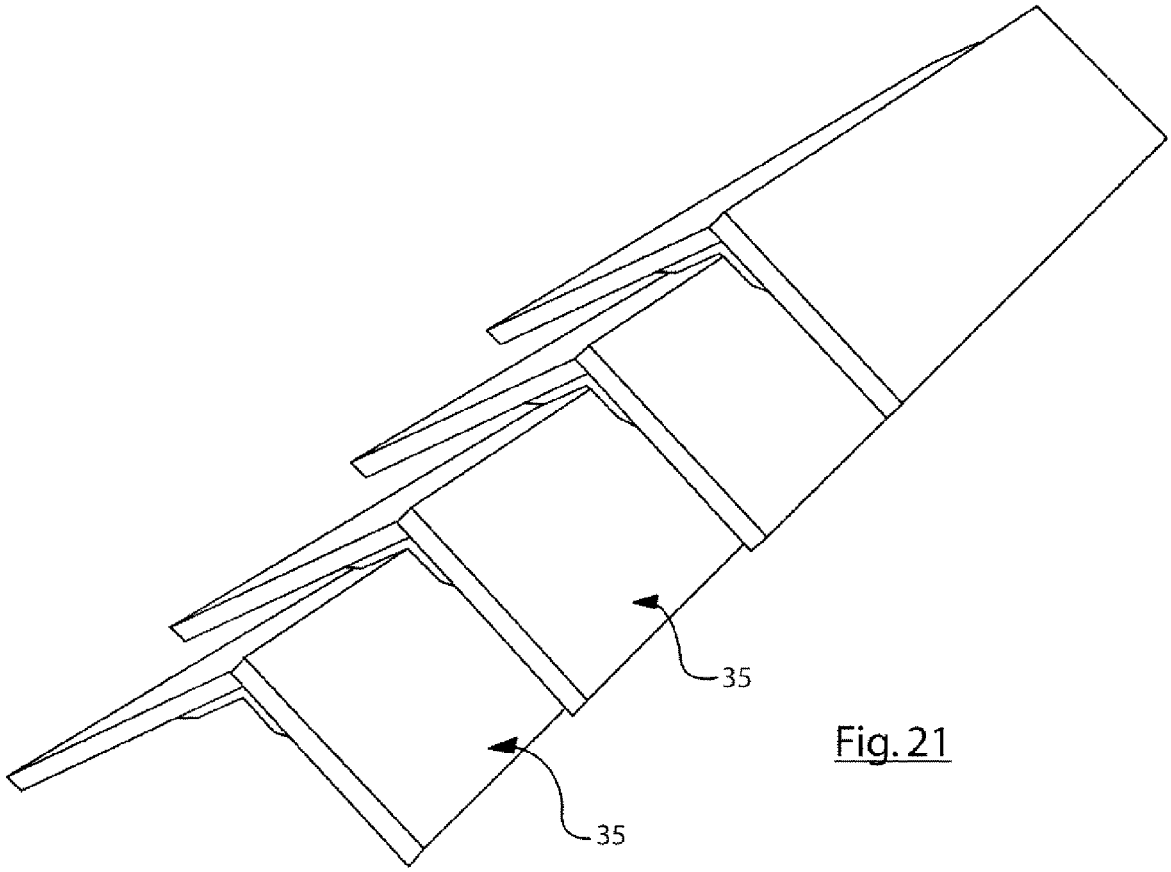
FIG. 21 is a top perspective view of an array of shingles in accordance with this invention, laid up, with lower portions of each successive shingle covering upper portions of a next-subjacent shingle, as they would be laid up along a ridge or apex of a roof.

With reference to FIG. 21, it will be seen that a plurality of shingles such as those 35 of FIG. 4 are applied in a course, at the apex of a roof, be it a hip roof (generally having four sloped surfaces), or along a ridge of two opposing sloped surfaces or the like, wherein the upper end of an underlying shingle is partially covered by the lower end or the next-overlying shingle, as shown.

Figure 22:
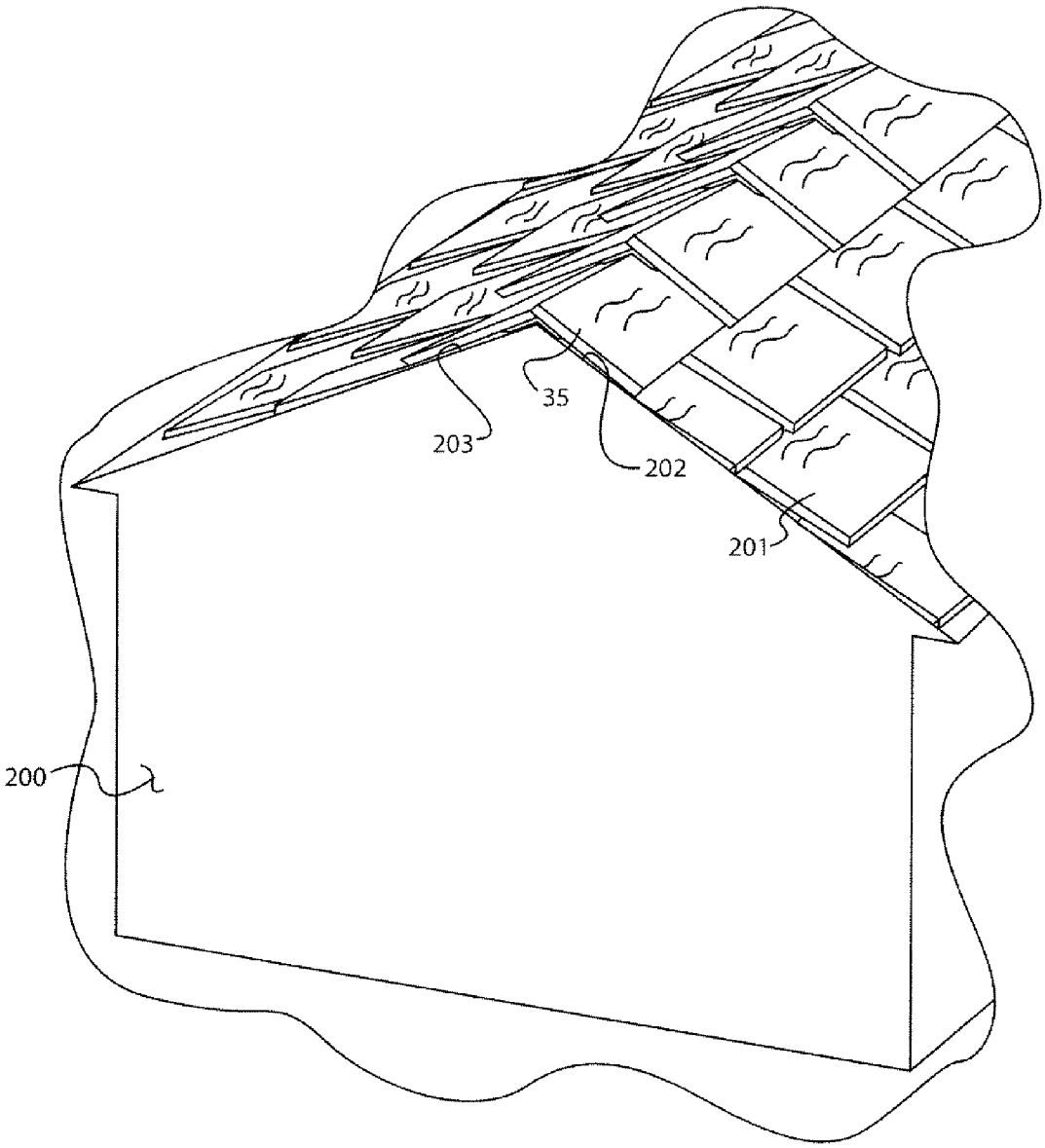
FIG. 22 is a fragmentary illustration of a building having shingles applied to different surfaces thereof which surfaces meet at a ridge, and wherein shingles of this invention similar to those of FIGS. 4 and 5, are applied to the ridge of the roof as shown in FIG. 21.

With reference to FIG. 22, it will he seen that a building 200 is shown, having a plurality of shingles 201 applied thereto, along two sloped surfaces 202 and 203, and wherein the ridge of those sloped surfaces 202 and 203, has a plurality of shingles 35 of the type illustrated in FIG. 21 applied thereto, in a course along a ridge.

Figure 23:
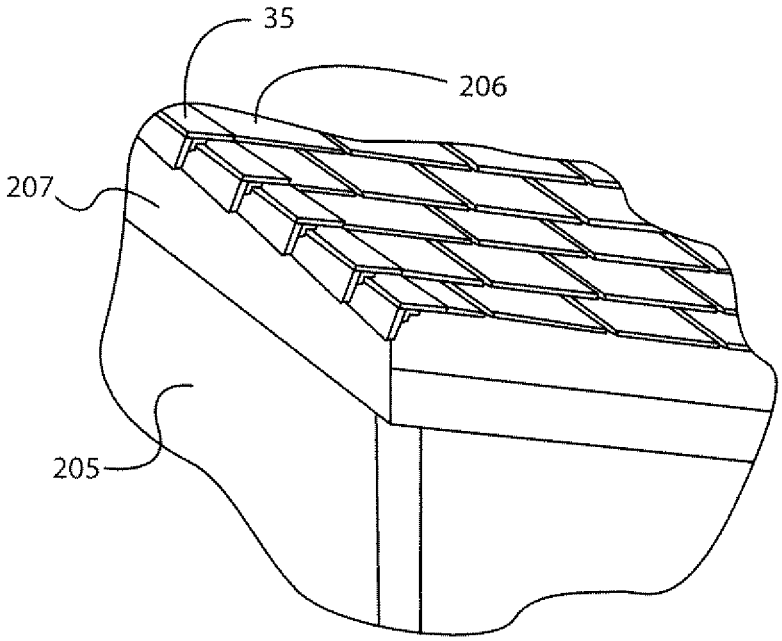
FIG. 23 is a fragmentary illustration of a building structure, wherein shingles in accordance with this invention are applied as rake shingles.

FIG. 23 illustrates the manner in which shingles of the type of this invention are applied to a building 205, in the manner of rake shingles, with one relatively rigid panel portion of each shingle overlying a sloped surface of a roof having roofing shingles applied thereto, as shown at 206, and with the other panel portion of the rake shingles applied partially covering a generally vertical surface 207 thereof.

The individual panel portions can be formed by known processes, such as compression molding, injection molding blow molding, or extrusion followed by compression molding. Additionally, other means of construction known in the art can be used to produce the shingles in accordance with this invention. It will thus be seen that the shingles in accordance with this invention can be pre-assembled as hip, ridge and rake shingles. It will also be seen that the shingles can be produced by having a separate hinge-like portion connecting separate substantially rigid panel portions. Alternatively, a profile extrusion can be used such as is shown in FIGS. 9-12, whereby the shingle panel portions are extruded from a die and the die includes a feature that becomes the hinge in a finished shingle when cut to shape. The profile extrusion can be an open flat overall shape, a folded overall shape, or a desired shape in between a folded shape (such as shown in FIGS. 8 and 9) and flat overall shapes (such as shown in FIGS. 10-15, 17 and 19). Also, the hinge-like portion can be produced by co-extrusion to produce a hinge with different physical or mechanical properties from the main portions or substantially rigid panel portions. Alternatively the hinge-like portion can be produced separately and assembled with the rigid panel portions to yield the shingle of the invention. The hinge-like portion or connection can be comprised of any of a laminated connection, a heat sealed connection, an adhesive connection a mechanical fastener connection, a co-extruded connection, and a molded connection. The substantially rigid portions can be made of a synthetic polymer that can be a thermoplastic material and may be comprised. in whole or in part of a polyethylene material, a polypropylene material, a polymethylpentene material, a polybutene material., a polyacrylate material, a polyvinylchloride material a fiber cement material (i.e. a cement-like material having fibers therein), or blends of various synthetic polymers, all as may be desired.

It will be apparent from the forgoing that various modifications can be made in the shingle of this invention, the details of construction, the formulations thereof, or the like, as well as in the use of the shingles, all within the spirit and scope of the invention as set forth in the appended claims.

What is claimed is:

1. A synthetic hip, ridge or rake roofing shingle of any of the simulated slate, tile or shake types, for placement over intersecting surfaces of a roof on a structure, as an underlying or overlying shingle in an assembly of such shingles, in which a portion of an underlying shingle is partially covered by a portion of an overlying shingle, closing the roof at the intersecting surfaces to prevent water from entering the roofed structure comprising a pair of substantially rigid planar portions for the hip, ridge or rake roofing shingle each having opposite ends, with the planar portions being connected by a hinge-like portion that is co-extensive between at least uncovered portions of the hip, ridge or rake roofing shingle between its ends when the shingle is installed on a roof structure, with the hinge-like portion being relatively flexible, relative to said substantially rigid planar portions, whereby the hip, ridge or rake roofing shingle hinge-like portion comprises means for conforming to a variety of different angles between said substantially rigid planar portions, corresponding to different intersecting angles of different adjacent roof surfaces, with the hip, ridge or rake roofing shingle comprising means for closing a portion of a roof at its intersecting surfaces for preventing water from entering a roofed structure at its intersecting surfaces, when the shingle is installed on a roofed structure.

2. The shingle of claim 1, wherein the hinge-like portion is comprised of the same material as at least a portion of the relatively rigid panel portions.

3. The shingle of claim 2, wherein the relatively rigid panel portions are of a first thickness and the hinge-like portion is at least partially comprised of a second thickness, which is thinner than said first thickness and therefore more flexible than said relatively rigid panel portions.

4. The shingle of claim 3, wherein said hinge-like portion is a co-extrusion of at least some of the same material as said panel portions.

5. The shingle of claim 1, where in the hinge-like portion is comprised of a different, more flexible material than at least some of the material of construction of the substantially rigid panel portions.

6. The shingle of claim 1, wherein said hinge-like portion includes a reinforcement member.

7. The shingle of claim 2, wherein there is a line of partial severance between the substantially rigid planar portions, which line terminates at said hinge-like portion.

8. The shingle of claim 1, wherein the substantially rigid planar portions are partially hollow.

9. The shingle of claim 1, wherein at least one of the substantially rigid planner portions has an upward projection extending above the hinge-like portion when installed on a roof with the substantially rigid planar portions disposed at an angle relative to each other.

10. The shingle of claim 6, wherein the reinforcement member is comprised of any of:

(a) woven scrim;
(b) a woven fabric;
(c) a non-woven scrim;
(d) a non-woven fabric; and
(e) a film.

11. The shingle of claim 10, wherein the reinforcement member is embedded in the hinge-like portion.

12. The shingle of claim 1, wherein the upper end of one panel portion covers an upper edge of the panel portion on the opposite side hinge-like portion.

13. The shingle of claim 1, wherein the hinge-like portion comprises an extrusion connecting said two panel portions.

14. The shingle of claim 1, wherein said hinge-like portion is connected to said panel portion by any of:

(a) a laminated connection;
(b) a heat seal connection;
(c) an adhesive connection;
(d) a mechanical fastener connection;
(e) a co-extruded connection: and
(f) a molded connection.

15. The shingle of claim 1, wherein said hinge-like portion is connected to said panel portions by mechanical interlock therewith.

16. The shingle of claim 1, wherein said panel portions are comprised of a core material having a capstock outer material layer covering portions of the panel portions that are weather-exposed in the installed condition on a roof.

17. The shingle of claim 1, wherein a layer of release tape connects the panel portions across the hinge-like portion to facilitate stacking in an uninstalled substantially flattened condition of said panel portions.

18. The shingle of claim 1, wherein a layer of release tape connects the panel portions across the hinge-like portion to facilitate openabilty of the hinge-like portion to accommodate various potential angles between the panel portions in the installed condition of the shingle on roofs of various angled surfaces.

19. A method of making a synthetic hip, ridge or rake roofing shingle of any of the simulated slate, tile or shake types, comprising the steps of:

(a) providing a synthetic shingle according to claim 1;
(b) bending the substantially rigid planar portions relative to each other along the hinge-like portion: and
(c) whereby the substantially rigid planar portions can conform to any of a variety of different intersecting angles corresponding to different intersecting angles of different adjacent roof surfaces.

20. The method of claim 19, wherein at least the substantially rigid planar portions of the shingle comprise polymeric material(s).

* * * * *